United States Patent [19]

Kerr, III et al.

[11] 4,451,529

[45] May 29, 1984

[54] COATED POLYSTYRENE FOAMS AND COMPOSITIONS AND PROCESSES FOR THE PRODUCTION THEREOF

[75] Inventors: Stuart R. Kerr, III, Pomona; Milton Meshirer, Riverdale, both of N.Y.

[73] Assignee: Beacon Chemical Company, Inc., Mount Vernon, N.Y.

[21] Appl. No.: 367,043

[22] Filed: Apr. 9, 1982

[51] Int. Cl.[3] ..... B05D 3/06

[52] U.S. Cl. ..... 428/319.3; 427/44; 427/54.1; 427/244; 428/520

[58] Field of Search ..... 427/44, 54.1, 244; 428/314.4, 314.8, 319.3, 319.7, 520

[56] References Cited

U.S. PATENT DOCUMENTS

| | | | |
|---|---|---|---|
| 3,583,884 | 6/1971 | Baum | 428/319.3 |
| 4,097,350 | 6/1978 | Pastor et al. | 427/54.1 |
| 4,097,417 | 6/1978 | Pastor et al. | 427/44 |
| 4,233,357 | 11/1980 | Taylor et al. | 428/314.4 |
| 4,319,811 | 3/1982 | Tu et al. | 427/54.1 |

*Primary Examiner*—John H. Newsome

*Attorney, Agent, or Firm*—Brooks, Haidt, Haffner & Delahunty

[57] ABSTRACT

Novel processes and compositions for producing expanded polystyrene articles coated with a durable, glossy, solvent-resistant integument, the compositions comprising a UV-curable oligomer, a UV-curable reactive diluent, and a photoinitiator, the compositions having a viscosity of from 800 to 20,000 cp. and the oligomer and diluent not being solvent for polystyrene, the compositions being cured by exposure to stated radiation to provide the durable coated articles, together with coated expanded polystyrene articles so produced.

12 Claims, No Drawings

COATED POLYSTYRENE FOAMS AND COMPOSITIONS AND PROCESSES FOR THE PRODUCTION THEREOF

BACKGROUND OF THE INVENTION

The present invention relates to novel coated polystyrene foam products and the compositions and processes for the production thereof, and more particularly, the present invention relates to expanded polystyrene articles coated with ultraviolet- or electron beam-cured polymeric materials, together with novel compositions and processes for the production thereof.

Expanded polystyrene materials, also known as polystyrene foams, have many useful properties which suit them for insulating and other uses. Moreover, they are generally available at low cost, especially in comparison to other available foams. Unfortunately, expanded polystyrenes are readily attacked by a host of organic solvents, and in many applications they cannot be used or they can be used only after other expensive treatment.

One difficulty with expanded polystyrene is its relatively low strength and poor elasticity. Placing relatively light finger pressure on expanded polystyrene will cause a small dimple or dent, and if the force applied is relatively minor, the expanded polystyrene has sufficient elasticity to recover fully or amost fully. On the other hand, however, with just slightly more force, as is easily developed by pressing a finger into expanded polystyrene, a permanent deformation results. Such a deformation adversely effects the cosmetic appearance of the expanded polystyrene, and in some uses is detrimental to performance of the material.

One of the outstanding characteristics of expanded polystyrenes is their very low density. This lends expanded polystyrenes to use in various applications requiring low density, such as flotation devices for swimming platforms, docks, and the like. Unfortunately, expanded polystyrenes are readily attacked by a very wide array of organic materials. Such property is especially experienced in certain flotation devices where oil, gasoline or diesel fuel, or other hydrocarbons are present on the surface of the water. These aliphatic and aromatic organic materials vigorously attack the expanded polystyrene and readily cause its dissolution. Floats and flotation devices have been almost entirely consumed under such conditions when they are made of expanded polystyrene.

Various techniques have been tried to exploit the advantages of polystyrene, while compensating for their low structural strength and their lack of resistance to solvents. Thus, small boats have been made by covering expanded polystyrene boat hulls with fiberglass and epoxy resins. It has also been proposed to fabricate aerodynamic surfaces from coated polystyrene, since in both these applications plastic deformation of the surface and high solvency cannot be tolerated. Various drawbacks have been noted in the use of epoxy resins to coat expanded polystyrene. For one thing, epoxy resins are palpably more expensive than other materials such as polyester resins, but unfortunately the polyester resins attack the expanded polystyrene and defeat the very purpose of coating the expanded polystyrene. Epoxy resins have considerable drawbacks in use. It is difficult to control their thickness, especially on surfaces with complex shapes, since the epoxy resins tend to be very viscous when they are first applied after the addition of catalysts to cause their polymerization, but during the course of their polymerization they become very thin and tend to flow from the surfaces upon which they are intended to be coated. Moreover, considerable technique is required to be developed to obtain proper catalysts and distribution on the surface so that the resin will cure completely on the expanded polystyrene article but will not cure too rapidly to be applied.

Another suggested technique for the protection of polystyrene surfaces is the use of a water-based material, such as the so-called latex paints. While latex paints can under some circumstances provide some protection for expanded polystyrene foams, they certainly do not significantly improve the strength of the expanded polystyrene and they are themselves susceptible to damage by hydrocarbon solvents. Moreover, the use of latex paints does not permit the achievement of decorative glossy surfaces on expanded polystyrene articles.

It would thus be desirable to be able to develop methods for coating polystyrene foam articles so that they would have enhanced strength and solvent resistance.

THE INVENTION

The present invention provides economical coated expanded polystyrenes and it also provides novel compositions which are based on acrylate-terminated esters of various materials which are cured by high energy irradiation, such as ultraviolet light or electron beams. The resulting coated polystyrenes ae durable, strong, and very resistant to ordinary solvents.

Briefly, the coating composition of the present invention are oligomeric acrylic esters of various materials in combination with certain styrene-inert reactive diluents and a photo-initiator system. These compositions have a viscosity generally ranging from 800 to about 20,000 centipoise at room temperature.

The processes contemplated according to the present invention comprise forming a thin layer of the novel compositions on the surface of the expanded polystyrene and then exposing the coated polystyrene to high energy radiation, as described herein. The novel coated products so obtained are remarkable for their freedom from attack by decomposition, their resistance to solvents, and the toughness and puncture resistance of the film. Moreover, the practice of this invention makes it possible readily to obtain a very glossy surface on the expanded polystyrene which greatly enhances its appearance and also confers ready cleanability of the surface so that expanded polystyrenes can readily be used in connection, for example, with foods or other hygienic uses, or for industrial uses such as poured concrete molds.

The coating compositions according to the present invention encompass a broad range of properties. This has the advantage that the coating materials can be applied by a wide variety of conventional methods. Thus, the novel coatings can be applied by brushing, roller coating, spraying, or dipping. The method utilized will depend upon the particular product desired. For example, if it is desired to produce a small artifact, such as an imitation apple, peach, or other small item with the appearance of a fruit or vegetable, the expanded polystyrene can be dipped in the compositions of this invention. On the other hand, if it is desired to coat a large object such as a float for marine use, the compositions of this invention can readily be brushed or sprayed onto the surface or surfaces to be protected.

Moreover, the processes of the present invention can be used on expanded polystyrenes having a wide range of densities, shapes, and uses. A glossy coating can be put on the imitation fruit or vegetable, described above, or a high-quality finish with the appearance of a good lacquer can be readily obtained on the surface of an expanded polystyrene material used as a picnic cooler. If appearance is the primary consideration, the cooler can be coated only on its exterior surfaces; while, if cleanability and maintainability are desired, the interior can also be coated to improve its appearance and to fill up the porous structure of the expanded polystyrene. The compositions of the present invention are fully compatible with block molded, shape molded, wire-cut, and other types of expanded polystyrene surfaces.

Work in connection with this invention has indicated that the coating materials can have various specific properties or a number of specified physical properties, depending upon the final use. Thus, coatings according to the present invention can be formulated for water resistance, gasoline resistance, impact resistance, vapor resistance, particular curing requirements, and the like.

The coating compositions of the present invention are also amenable to the use of additives to improve their appearance and to provide special effects. Thus, the compositions of this invention can contain a wide number of adjuvent materials. They have been formulated with a variety of pigments to provide both bright and muted colors for various articles. Metallic flakes have been added to provide very attractive speckled tones. The use of scrims of ordinary textile fabrics, fiberglass or polypropylene fabrics or scrims and other fibrous coverings have been used to provide an unusual or desirable texture to the surface and/or to reinforce the surface and provide further strength and resistance to denting, dimpling, or other deformation. It will accordingly be appreciated by those skilled in the art that the expanded polystyrene products coated according to the present invention provide a variety of opportunities such as for point of purchase displays, display packaging, flotation devices, coolers, toys, ornaments, concrete form liners, slab edge insulation for reinforced concrete and other structural materials, and a variety of other uses.

One of the components of the coating compositions is an ultraviolet (UV)-curable oligomeric resin. As used herein, the term UV-curable will also be taken to encompass curability of other such high-energy forms of radiation, including exposure to electron beam radiation and the like. It has generally been found that UV irradiation provides very satisfactory results and can be used with a minimum of special equipment. Thus, UV irradiation is preferred in many embodiments of the invention. It should, however, be noted that when considerable coating depths are involved, electron beam (EB) irradiation or other higher energy irradiation can be desirable.

The UV curable oligomeric resins are of sufficiently high molecular weight that they themselves do not attack the surface of the expanded polystyrene. They generally confer fast UV cure response, and many are light colored. They impart very good resistance to solvents, including methylethyl ketone, benzene, toluene, ethyl acetate, and the like. At the same time, they can impart extremely high surface hardness. If desired, a combination of oligomers can be used to provide good surface hardness with considerable elasticity so that the finished article is quite resistant to impacts. As noted above, the impact resistance can be improved with woven or other fabrics of scrims and the like.

The oligomers in many embodiments provide a very high gloss surface. Where a high gloss surface is not desirable, the oligomers can be chosen to provide a lesser gloss, or additives such as fine powders can be used to reduce gloss and, in some embodiments, to reduce surface slipperiness, as might be desired for certain areas of a marine float, for instance.

In certain preferred embodiments, the oligomers are diacrylate materials, and are most commonly esters of such materials. The main portion of the molecule is provided by polyester or epoxy resin materials. Diacrylate esters based on biphenyl epoxy resins are especially preferred in certain embodiments of the invention.

Unless the UV-curable oligomer is itself of very low viscosity, the composition must also contain a reactive diluent. The quantity of reactive diluent used is sufficient to bring the room temperature viscosity of the coating composition within the range of 800 to 20,000 centipoise (cp). In certain preferred embodiments of the invention, the viscosity of the coating composition at room temperature should be from about 1000 to about 10,000 cp. If the viscosity of the coating compositions of this invention are too high, they will lack spreadability on the surface of the expanded polystyrene. Moreover, they will fail to wet the surface, and it will also be extremely difficult to apply them.

Conversely, too low a viscosity will result in a coating which will cure, but which will have no integrity. It will form a film only with difficulty and will be porous so that the solvent resistance, cleanability,, and gloss advantages obtained according to the invention will be lost. Moreover, too low a viscosity will cause difficulty in obtaining a sufficient thickness of coating.

The reactive diluent must be curable under the influence of ultraviolet light or irradiation, and it must not attack polystyrene, at least at temperatures up to 180° F. The screening process for reactive diluents involves placing a drop of the reactive diluent on expanded polystyrene at room temperature. After ten minutes, the surface of the expanded polystyrene is visually checked for any pitting or other signs of attack. If the reactive diluent passes this test, the expanded polystyrene is then exposed to UV irradiation, with a drop of reactive diluent containing photoinitiator, and the expanded polystyrene is again examined for attack. if there is none, the reactive diluent will be suitable for use according to the present invention. One of the advantages of the present invention is that any oligomer compatible with the diluent is acceptable, provided only that it is curable under UV irradiation.

It should be understood that the specified room temperature viscosities do not represent limitations on the practice of this invention, as the viscosity of the coating will diminish with increased temperature. Thus, one coating composition according to the present invention has a room temperature viscosity of 2500 cp; however, at 140° F., the viscosity of the coating composition is 275 cp. Much commercial spray equipment is limited to a maximum viscosity of about 400 cp for easy spraying without special precautions. It is one of the advantages of the present coating compositions that they can be heated to reduce their viscosity for use in spray-coating and like equipment without causing unwanted premature polymerization, thermal breakdown, or other unwanted effects.

Chemically, the reactor monomers utilized in the practice of this invention are polyfunctional acrylate materials. Fortunately, they exhibit low skin irritancy. Further, they are useful in ultraviolet and electron beam radiation curing applications. They not only function as viscosity control agents in the coating compositions, but they themselves being UV-curable, enter into the reaction and form excellent coatings in conjunction with the aforesaid oligomers.

The final component of the coating compositions according to the present invention are one or more photoinitiators. Desirably, the photoinitiator is a clear or light-colored, fast-acting material. It should be stable in storage. The photoinitiators desirably used in the practice of the present invention can generally be classed as those particularly suitable for acrylate and modified UV-curable acrylate resins. Chemically they are ketones which are capable of photoinitiating UV cures. Desirably, they are soluble in the combination of reactive monomer and oligomer. While a variety of ketones can be used, branched aliphatic-aromatic ketones have been found to give excellent results in the practice of this invention. Examples of preferred photoinitiators thus include 2,2-dimethoxy-2-phenylacetophenone, 2-hydroxy-2-methyl-1-phenylpropane-1-one, and the like.

In general, the spectral range of interest for UV curing according to the present invention is in the range of 300 to 400 nanometers (nm). Medium-pressure mercury arc lamps offer their maximum output in this preferred range. These lamps, which are commercially available at intensities of 100 watts per inch to 300 watts per inch can effectively cure coatings up to 20 mils in thickness. It has generally been found that shorter wave length UV tends to concentrate at the surface of the coating and does not provide the desirable deeper penetration.

In practicing the process of the present invention for coating expanded polystyrene, in addition to the lamp, the UV assembly should utilize an efficient reflector, preferably elliptical, irradiation shield, an air or water cooling system, a power source, and the proper control equipment. At typical processing speeds, the heat generated in the substrate by the UV lamps is fairly low, generally on the order of 120° to 160° F. In continuous operation, provision should be made for control of the irradiation during line stoppages, however, because these may expose the product to excessive temperatures and cause the coating and the substrate, that is, the expanded polystyrene, to deteriorate. It may be useful to provide infrared filters, as these reduce the incident infrared radiation and further minimize the generation of heat.

It will be appreciated by those skilled in the art that a coating system designed to cure upon the application of heat contains a resin binder and a vehicle. Normally, after application to a product, the vehicle is driven off and the coating is then cured by applying heat. Unfortunately, the resin frequently forms a skin which impedes the evaporation of the vehicle and this necessitates prolonged curing cycles.

In the ultraviolet curing according to the present invention, the combination of the liquid reactive monomer and the oligomer eliminates the need for vehicles or water. The coating is completely reactive and the amount or thickness that is laid down wet is essentially the thickness which remains after curing. Simple irradiation from a UV lamp results in a totally cured, cross-linked coating which is then very resistant to both chemicals and heat. The coating requires curing for only a short time and the temperature rise in the expanded polystyrene substrate is minimal.

Another advantage obtained according to the present invention is the relatively high covering in square feet per gallon of the coating composition. Thus, with expanded polystyrene, a one-mil thickness can be obtained at a coverage rate of 1200 square feet per gallon with other coverages being comparable. Thus, a five-mil coating thickness is obtained at 240 square feet per gallon.

All parts, percentages, proportions and ratios herein are by weight, unless otherwise indicated.

The following Examples are given to illustrate embodiments of the invention as it is presently preferred to practice it. It will be understood that these Examples are illustrative, and the invention is not to be considered as restricted thereto except as indicated in the appended claims.

EXAMPLE I

The following UV-curable composition is prepared:

| Ingredient | Amount (oz) |
|---|---|
| Celrad 3701 UV-curable diacrylate ester of bisphenol A-type epoxy resin oligomer | 20 |
| Celrad 3600 UV-curable diacrylate ester of bisphenol A epoxy resin oligomer | 12 |
| Photomer 4039 acrylate monomer | 10 |
| Photomer 4028 modified acrylate monomer | 6 |
| Irgacure 651 phenylacetophenone photoinitiator | 0.5 |
| Darocur 1173 phenylpropanone photoinitiator | 0.5 |

This composition is coated on expanded polystyrene to give a 3-mil thickness on the surface of the expanded polystyrene and the coated polystyrene is then exposed to ultraviolet radiation from a medium-pressure mercury arc lamp. The coating composition cures in approximately two seconds to form a hard, durable, glossy finish on the surface of the expanded polystyrene.

This coating is highly resistant to solvents. In a compression test using a 63 mil by one inch compression fixture, a maximum reading in excess of 60 pounds is obtained. When uncoated expanded polystyrene is subjected to the same test, a reading of about six pounds is obtained.

The foregoing coating composition is pigmented with 0.5 ounces of blue pigment and further augmented with 0.7 ounces of aluminum flakes. The coating composition is used to cover expanded polystyrene with a thickness of 5 mils and is found to give a bright, sparkling, durable, solvent resistant, decorative, glossy surface to the expanded polystyrene.

EXAMPLE II

Equal parts of the diacrylic acid ester of bisphenol A epoxy resin and of the diester of the diglycidyl ether of bisphenol A are combined to provide a UV-curable oligomer component "A". An aromatic monofunctional homolog of 2-phenoxyethyacrylate and bisphenol A acrylate are combined in the ratio of 70:30 to provide a reactive diluent "B" component.

The following mixture is then prepared:

| Ingredient | Amount (Parts) |
|---|---|
| Component "A" | 62 |
| Component "B" | 35 |
| 2,2-Dimethoxy-2-phenylacetophenone photoinitiator | 1.25 |
| 2-Hydroxy-2-methyl-1-phenylpropanone photoinitiator | 1.25 |

Ten parts of the foregoing mixture are admixed with 0.2 parts of red pigment and a 3-mil coating is then sprayed on an expanded polystyrene panel. The panel is cured with a UV lamp, and the actual cure requires less than three seconds. Thereafter ten parts of the foregoing mixture are combined with 0.5 parts of metal flakes and this mixture is coated on the cured panel, and cured with ultraviolet radiation as before to provide an attractive panel suitable for decorative purposes.

Some of the coating composition of Example I is sprayed on structural slabs of expanded polystyrene foam so as to coat the top of the slab and the four surfaces conterminous with the top. The panels are then cured with UV radiation to provide panels coated on five sides, with the bottom face uncoated. Tests indicate that this normally water-permeable polystyrene foam is sealed so that it can be used over ordinary roofing tar and paper to form an insulating barrier which will not permit water to destroy the integrity of the expanded polystyrene by penetrating into the expanded polystyrene structure and then freezing.

In addition to diacrylate esters with the main portion or backbone of the molecule provided by polyester or epoxy resin materials, as described herein, the main portion can also comprise acrylic or isocyanato materials. Such materials can accordingly also provide multicure oligomers. In cases where oligomers have a low enough viscosity, little or no reactive diluent need be used.

It will be understood by those skilled in the art that the expanded polystyrene substrates according to this invention can be formed by any of the available techniques. They can be extruded, formed in situ, or pellets or beads which expand under the influence of steam.

In general, thicknesses of coatings used according to the present invention range from one to 50 mils in thickness. Thinner coatings can result in greater difficulty in covering the polystyrene surface, and one of the desiderata is an essentially unbroken integument on the polystyrene. Thicker coatings generally do not confer any special advantages and tend not to be cost-effective.

What is claimed is:

1. A process for producing expanded polystyrene articles having at least one surface thereof coated with a tough, durable, impact resistant solvent-resistant integument, the process comprising covering the surface of the article with a UV-curable coating composition and irradiating the covered surface with ultra-voilet or electron beam radiation to cure the composition and form the integument, the composition comprising a UV-curable diacrylate oligomer, an acrylate-terminated reactive diluent, and a photoinitiator, the inert diluent being present in an amount to provide a viscosity of from 800 to 20,000 centipoise, at room temperature, to the coating composition and the oligomer and diluent being inert to the polystyrene.

2. A process according to claim 1 wherein the diluent provides a viscosity of from 1000 to 10,000 centipoise.

3. A process according to claim 1 wherein the thickness of the coating is from about one to about 50 mils.

4. A process according to claim 1 wherein the article is sprayed with the composition.

5. A process according to claim 1 wherein the article is dipped in the composition.

6. A process according to claim 5 wherein the coating on the article is cured after dipping and the article is dipped at least one more time and cured after each dip.

7. A process according to claim 1 wherein the composition is brushed on the article.

8. A process according to claim 1 wherein the surface is additionally covered with a fabric prior to cure of the composition.

9. A composition according to claim 1.

10. A composition according to claim 9 which additionally contains at least one adjuvant to alter the appearance of the coating.

11. A composition according to claim 9 wherein the oligomer is an acrylic acid ester.

12. An expanded polystyrene article having a durable, solvent-resistant coating on at least one surface thereof, produced according to the process of claim 1.

* * * * *

UNITED STATES PATENT AND TRADEMARK OFFICE

CERTIFICATE OF CORRECTION

PATENT NO. : 4,451,529

DATED : May 29, 1984

INVENTOR(S) : STUART R. KERR, III ET AL

It is certified that error appears in the above-identified patent and that said Letters Patent is hereby corrected as shown below:

Column 1, line 27, correct the spelling of "almost"; line 31, correct the spelling of "affects".

Column 2, line 29, correct the spelling of "are"; line 31, change "composition" to --compositions--.

Column 4, line 2, change "of" to --or--.

Column 8, line 11, correct the spelling of "ultra-violet".

Signed and Sealed this

*Eighteenth* Day of *December 1984*

[SEAL]

*Attest:*

GERALD J. MOSSINGHOFF

*Attesting Officer*

*Commissioner of Patents and Trademarks*